US006500010B2

(12) United States Patent
Yatskov

(10) Patent No.: US 6,500,010 B2
(45) **Date of Patent: *Dec. 31, 2002**

(54) ELECTRICAL CIRCUIT CONNECTOR WITH RESILIENT PRESSURE PADS

(75) Inventor: Alexander I. Yatskov, Kenmore, WA (US)

(73) Assignee: Cray Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/797,791

(22) Filed: Mar. 2, 2001

(65) Prior Publication Data

US 2002/0123259 A1 Sep. 5, 2002

(51) Int. Cl.[7] ..... H01R 12/00
(52) U.S. Cl. ..... 439/67; 439/493
(58) Field of Search ..... 439/493, 67, 74, 439/65, 66

(56) References Cited

U.S. PATENT DOCUMENTS 4,611,869 A * 9/1986 Bonnefoy ..... 439/67
4,647,125 A * 3/1987 Landi et al. ..... 439/67
4,850,883 A * 7/1989 Kabadi ..... 439/67
4,913,656 A * 4/1990 Gordon et al. ..... 439/67
4,948,374 A * 8/1990 Carter ..... 439/67
4,997,389 A * 3/1991 Doumani et al. ..... 439/493
5,161,981 A * 11/1992 Deak et al. ..... 439/66
5,306,162 A * 4/1994 Armendariz ..... 439/67
5,730,618 A * 3/1998 Hamlin ..... 439/493

* cited by examiner

*Primary Examiner*—Gary R. Paumen
*Assistant Examiner*—Ann McCamey
(74) *Attorney, Agent, or Firm*—Harold H. Bennett, II; Seed IP Law Group PLLC

(57) ABSTRACT

An electrical connector includes a flexible circuit substrate extending between a pair of mechanical connectors to electrically couple circuits, and a supporting member between the mechanical connectors to reduce twisting of the flexible circuit substrate. The supporting member cambered to permit the mechanical connectors to translate with respect to one another. A clamping member includes a tapered clamping surface in an undeformed, unclamped position. The clamping member bends when in a clamped position, resulting in approximately planar clamping surface. Resilient pressure pads on the clamping members bias the flexible circuit substrate to the circuit board. The pressure pads are mounted in wells in the clamping members to support a side wall of the pressure pads. Frames provide additional support to the side walls of the pressure pads. The pressure pads include a raised edge along a periphery of a contact surface of the pressure pad. Additionally, or alternatively, a support shoulder in the well cooperates with a recess along a periphery of a mounting surface of the pressure pad to support the side wall. Alignment structure on the frame cooperates with alignment structure on the clamping members, the printed circuit boards and the flexible circuit substrates to align contacts on the flexible circuit substrates with contacts on the printed circuit boards, and to further align the pressure pads with the contacts.

31 Claims, 9 Drawing Sheets

ELECTRICAL CIRCUIT CONNECTOR WITH RESILIENT PRESSURE PADS

TECHNICAL FIELD

This invention relates to electrical connectors, and more particular to electrical connectors for coupling circuits on printed circuit boards.

BACKGROUND OF THE INVENTION

Many computing devices, such as desktop computers, workstations, mainframe and super-computers employ multiple printed circuit boards ("PCB") that include various microprocessors, printed circuits and other components that must be electrically coupled together to transmit data and/or power. The electrical traces on one or more layers of the PCB form the printed circuits and typically terminate in one or more terminals or contacts for making connections. Ever decreasing element sizes, such a pitch (i.e., the spacing between successive components), width, and height, exacerbate the problem of providing secure and reliable connections between the printed circuits. Precise positioning on the order of thousandths of an inch is often necessary. Consistent pressure across each of the many contacts is also desirable to assure a reliable connection. A single failed or intermittent connection can result in large amounts of "down-time" for the computing device, and costly trouble-shooting by highly skilled technicians.

Flexible circuit substrates provide low resistance, low impedance connections. Such connections are particularly desirable in parallel processing systems, where the timing of signals is critical. Flexible circuit substrates consist of a number of electrical traces on a small number of layers (e.g., approximately 2–8) of printed circuit board material (e.g., FR-4 epoxy-fiberglass laminate). The resulting substrate is highly flexible, hence convenient for making connections in tight spaces and/or at an angle. However, because of their flexibility, such connectors present a challenge in providing even contact pressure across all contacts.

Highly parallel processing super-computers present a particularly significant problem in terms of space constraints. These computers rely on a high number of connections between circuit boards that each carry one or more microprocessors. The nature of parallel processing places high demands on the timing of signals, including clock signals across the various computer components. The PCBs are spaced relatively close together to reduce the length of the connections between the PCBs in an effort to improve the timing of the signals. The tight spacing hinders the ability of technicians to access particular computer components, such as the PCBs and electrical connectors. This presents a particular problem to computer manufacturers and owners who desire a modular design that permits failed components to be quickly and easily replaced. If serviceable, a modular design would also permit the addition of new or additional processors as desired, for example when more processing power is required or when the processors become more affordable. This could significantly extend the life of the computing device.

A reliable, precise, and highly manipulable electrical connector is required to couple printed circuits between printed circuit boards. Additionally the connection should be secure over a time period commensurate with the expected life of the computing device to avoid costly maintenance and should allow easy replacement and/or addition of various computer components such as PCBs.

SUMMARY OF THE INVENTION

Under one aspect of the invention, resilient pressure pads carried by opposed clamping members of an electrical connector bias flexible circuit substrates to a circuit board. Respective wells in the clamping members receive the pressure pads and provide support to a side wall of the pressure pads. Frames carried by the clamping members provide additional support to the side walls of the pressure pads.

Under another aspect of the invention, the pressure pads include a raised edge along a periphery of a contact surface of the pressure pad. Additionally, or alternatively, a support shoulder in the well cooperates with a recess along a periphery of a mounting surface of the pressure pad opposed to the contact surface.

Under another aspect of the invention, the pressure pads include a resilient pressure pad core having a first durometer value and a resilient pressure pad sleeve having a second duormeter value greater than the first durometer value.

Under a further aspect of the invention, alignment structure on the frame cooperate with alignment structure on the clamping members, the printed circuit boards and the flexible circuit substrates to align contacts on the flexible circuit substrates with contacts on the printed circuit boards, and to further align the pressure pads with the contacts.

BRIEF DESCRIPTION OF THE DRAWINGS

In the drawings, identical reference numbers identify similar elements or acts. The sizes and relative positions of elements in the drawings are not necessarily drawn to scale and various elements and portions of elements may be are arbitrarily enlarged and positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, printed circuit boards, circuits and mechanical clamps have not been shown or described in detail to avoid unnecessarily obscuring descriptions of the embodiments of the invention.

The headings provided herein are for convenience only and do not interpret the scope or meaning of the claimed invention.

Figure 1:
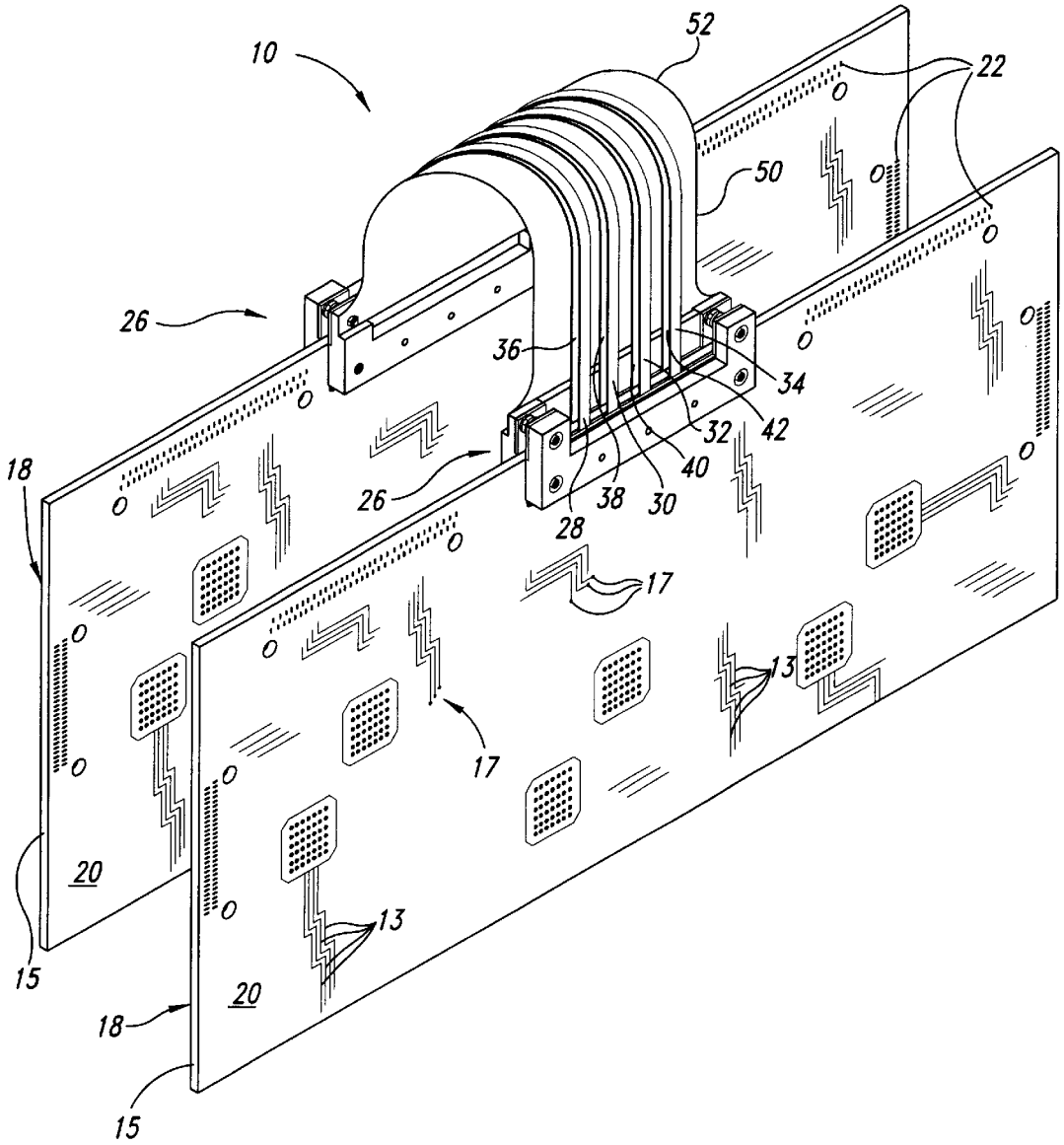
FIG. 1 is an isometric view of a connector according to the present invention coupling circuits on two printed circuit boards in side-by-side relation.

FIG. 1 shows a connector 10 coupling printed circuit boards 15 ("PCBs") according to the present invention. The connector 10 includes a first and second clamps 24, 26, and a first set of electrical connectors, such as four flexible circuit substrates 28–42, electrically coupling circuits on the first PCB 14 to circuits on the second PCB 16. The connector 10 also includes a flexible support member 50 that provides mechanical support and stability to the connection.

Figure 2:
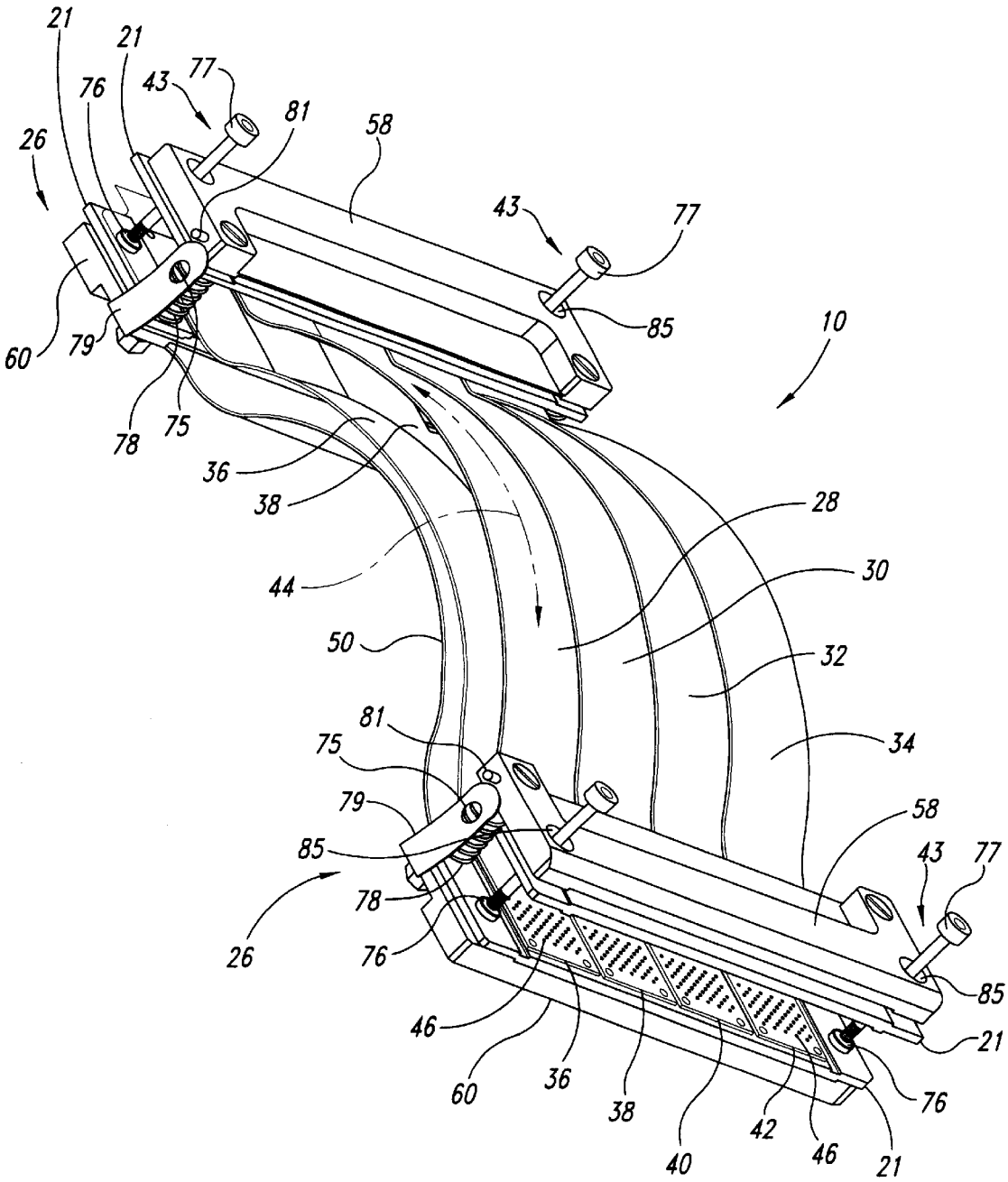
FIG. 2 is an isometric view of the connector according to the present invention, positioned to couple circuits on two printed circuit boards in the same plane.

FIG. 1 shows two printed circuit boards ("PCBs"), in a side-by-side, parallel arrangement. FIG. 2 shows the connector 10 in position to couple circuits on two PCBs, where the PCBs are in the same plane. The PCBs are not shown to make visible the connecting surfaces of electrical conductors 36–42. The circuit boards are of a type used in a super computer or large mainframe computer. Thus, each board will have many electronic components, including many microprocessors. A single computer may have a dozen or more boards with different positions with respect to each other that must be connected. While parallel and side-by-side connections are shown, they may also be stacked, one above another or be arranged in some other configuration.

The PCBs 15 are formed from one or more layers of an insulating material, such as FR-4 epoxy-fiberglass laminate. The PCBs 15 are typically sufficiently thick to form a rigid substrate, although minor amounts of bending or deflection can occur. The printed circuits include electrically conductive circuit traces 13 and various electrical and electronic components (not shown) on one or both surfaces 18 and 20. surface 20 of PCBs 14, 16 is visible in FIG. 1, while surface 18 of PCBs 14, 16 is facing away from the viewer as seen in FIG. 1. Each layer of the PCB 14, 16 can also carry circuit traces (not shown) where the PCB 14, 16 is a laminate structure. Through-holes 17 can provide connections between circuit traces 13 on outer surfaces 18, 20 and/or inner layers of the PCB 14, 16. The printed circuits include electrical contacts 22 to couple the printed circuits to other electrical circuits. The electrical contacts 22 are located close to the edges of the PCB 14, 16 to make the coupling easier.

Flexible circuit substrates 28–42 extend into the clamps and have exposed contacts for connecting to contacts on the printed circuit board.

The flexible circuit substrates 28–42 provide low resistance, low impedance connections. Such connections are particularly desirable in parallel processing systems, where the timing of signals is critical. The flexible circuit substrates 28–42 consist of a number of electrical traces (not shown) formed on a small number of layers (e.g., approximately 2–8) of insulated substrate material. The substrate can be printed circuit board material (e.g, polyimide film, FR-4 epoxy-fiberglass laminate), or any acceptable alternatives. The resulting substrate 28–42 is highly flexible, hence convenient for making connections in tight spaces and/or at an angle.

A difficulty that is inherent in the use of flexible substrates for connectors is the issue of contact pressure. Where a rigid connector will require a given amount of force to provide contact pressure sufficient to ensure solid connections, in a flexible connector that force must be distributed evenly across the connector. Because of its flexibility, force at one part of the connector does not translate to contact pressure at another.

Figure 3:
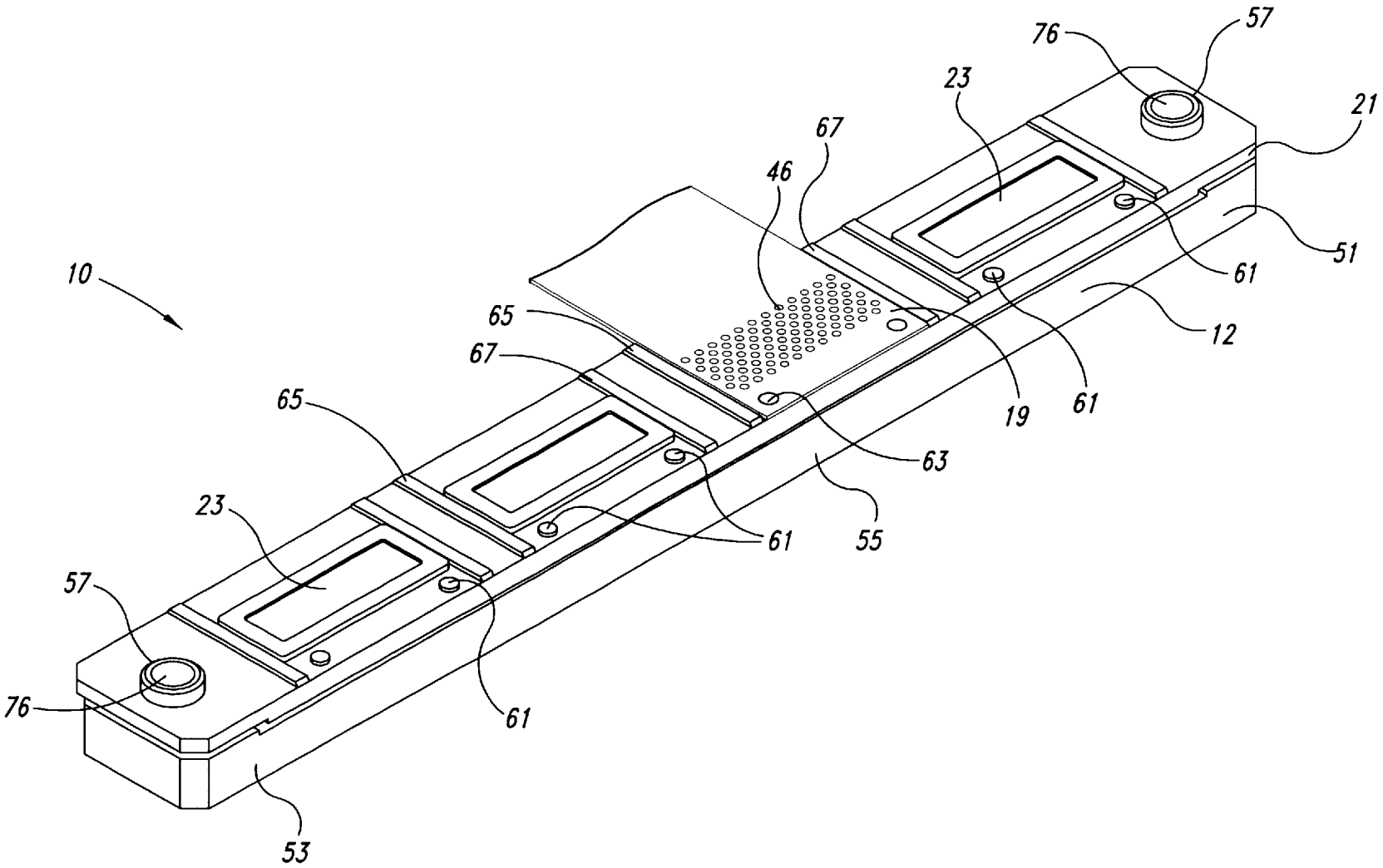
FIG. 3 is an isometric view of a clamping member having a frame and an electrical connector thereon according to the present invention.

FIG. 3 shows a clamping assembly 10 composed of a clamping member 12, a frame 21 and pressure pads 23. An electrical connector 19 is shown in position ready for connection to a circuit board by clamping assembly 10. The clamping member 12 has a first end 51 and a second end 53 and a central portion 55. According to a preferred embodiment of the present invention, the central portion 55 is somewhat thicker than at the ends 51 and 53. This will be explained, and shown in more detail, with respect to FIGS. 9–10. Posts 57 on the clamping member 12, and collars 59 in the frame 21 are provided at each of the ends 51, 53 in order to receive and provide alignment between the clamping member 12 and the frame 21. (see also FIG. 4)

Posts 57 on the clamping member 12 pass through collars 59 in the frame 21, and engage holes 83 in the PCB 15 to provide reliable alignment between the contacts 46 of the flexible connector 19, and the contacts 75 of the circuit board 15. (see also FIGS. 9 And 10)

Figure 9:
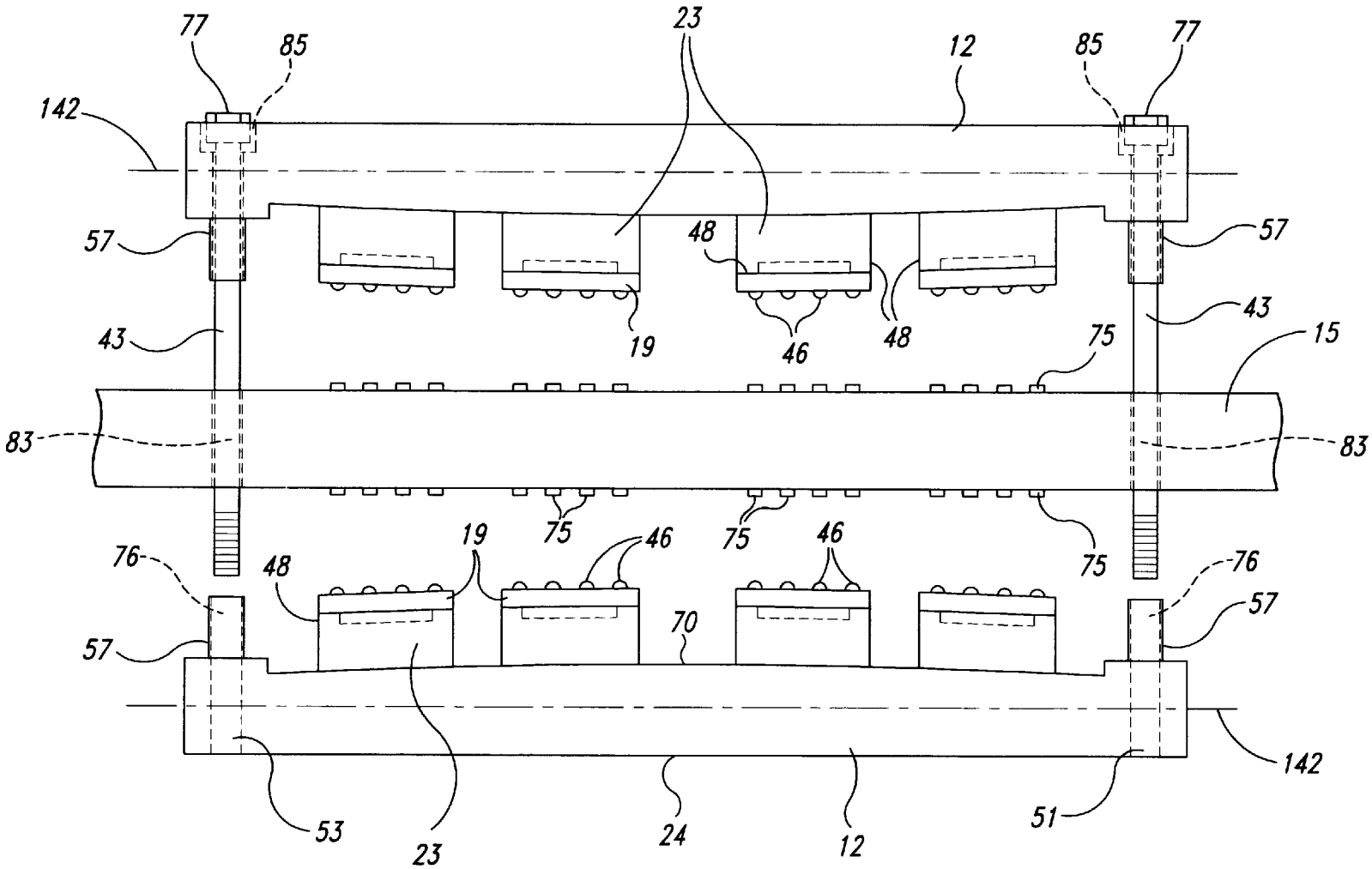
FIG. 9 is a front elevational view of the printed circuit board and electrical connectors received between the clamping members and pressure pads that are undeformed while in an unclamped position.
Figure 10:
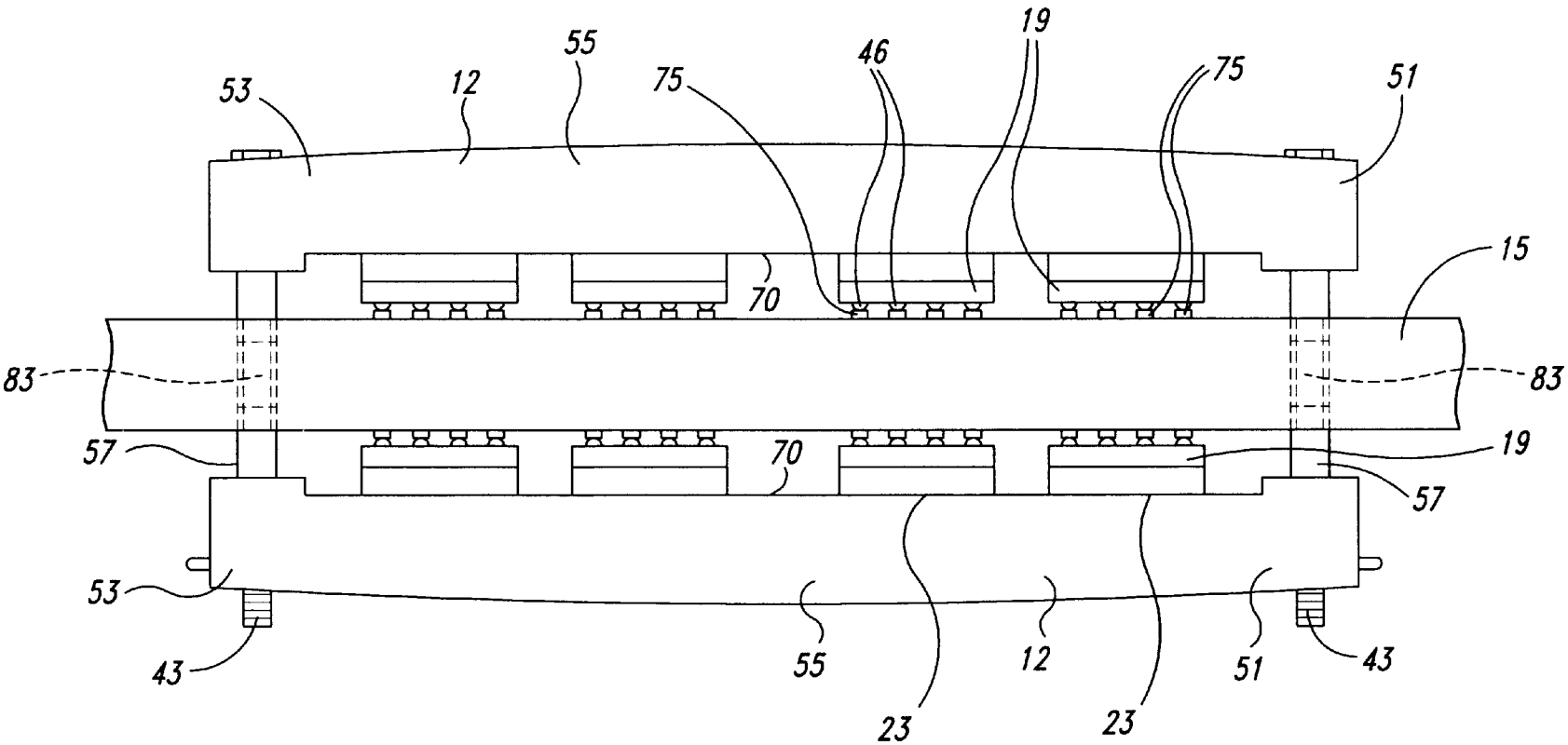
FIG. 10 is a front elevational view of the printed circuit board and electrical connectors received between the clamping member and pressure pads that are deformed while in the clamped position.

Frame 21 rests on top of and in alignment with clamping member 12. The frame 21 includes an electrical connector alignment structure in the form of a set of pins 61 sized and dimensioned to engage a pair of holes 63 in the end of the electrical connector 19. The pins 61 align a plurality of electrode contacts 46 on an end of the electrical connector 19 with the respective pressure pad 23. The alignment structure may also include, in an alternative embodiment, horizontal guide bars 65 and 67 on either side of the strip so as to pre-position the electrical connector 19 in the proper location on the frame 21. In some embodiments, guide bars 65 and 67 are not used and instead the pressure pad and pins 61 are in a recess to provide alignment. Of course, any acceptable alignment structure can be used, and those shown here are merely given for example to illustrate ways in which the electrical connector 19 can be ensured to have proper alignment on top of the pressure pad 23 to make good electrical contact when the clamping occurs, as shown in FIGS. 9 and 10. The alignment structures on the clamping members 12, frames 14 and electrical connectors 19 cooperate to ensure that the contacts 46 on the electrical connectors 19 precisely align with the contacts 75 (FIGS. 9 and 10) on the surfaces of the respective printed circuit boards 15. Precise alignment is important to providing secure, reliable electrical connections.

Figure 4:
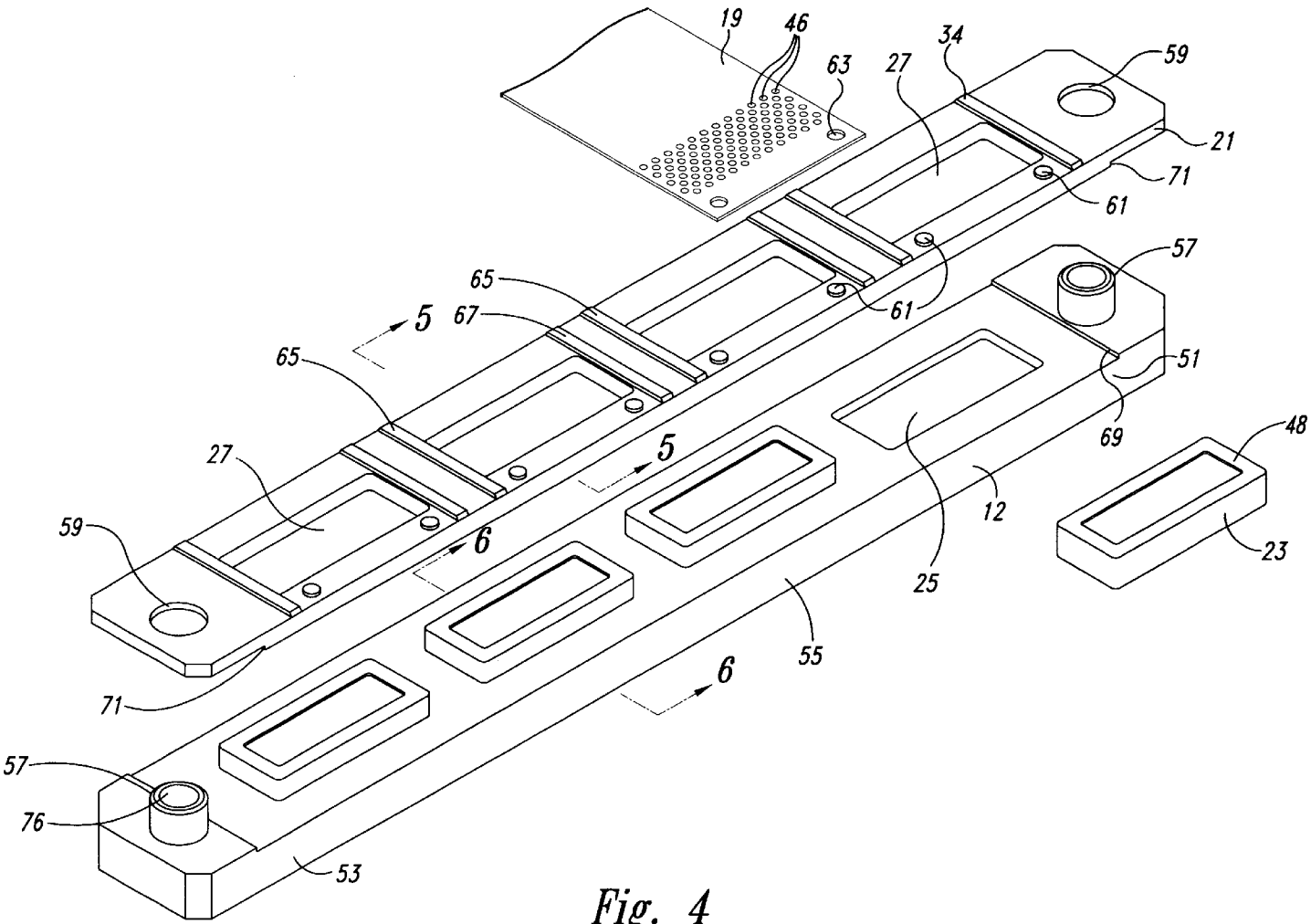
FIG. 4 is an exploded view of FIG. 3, showing the individual components more clearly in the direct embodiment.

FIG. 4 shows an exploded view of the clamping assembly 10. The clamping member 12 includes a recess 25 into which the pressure pads 23 are positioned. The pads 23 may be held in position by a pressure fit, or by adhesive, either method being acceptable. The pressure pad 23 includes a raised edge 48 as described in more detail later with respect to FIG. 6 and 7. The frame 21 is shaped to be positioned on top of and aligned with the clamping member 12. It contains apertures in each end to align with the posts and collars 57 and 59 of the clamping member. A shoulder structure 69 is present in this embodiment of the invention as a by-product of the machining of the clamping member 12 to produce the thinning of the ends 51, 53. The ends of the frame 21 have a recess 71 which accommodates the shoulder 69 when the clamping assembly is in the fully clamped position. Other configurations may also be used to mate and align the frame 21 with the clamping member 12

The frame 21 contains apertures 27 that align with and surround pads 23. The side walls of the apertures 27 provide support to the sidewalls of the pad 23 so as to provide a solid surface for even pressure to the electrical contact members 46. This arrangement of the frame 21, together with the pad 23 and the clamping member 12 provides for the easy assembly of the clamping assembly 10 as a whole. It also ensures proper and correct alignment of the electrical contacts 46 with the printed circuit boards.

In an alternative embodiment, the frame 21 is not used. Instead, the recesses 23 and the clamping member 12 are made deeper and the pad 23 is positioned within the deep recess to provide support to the sidewalls. In addition, the alignment structures 61 are positioned on the clamping member 12 to align and mate with the apertures 63 of the electrical connectors 19.

The frame 21 includes raised guides 65 and 67 on its upper surface to provide an additional prealignment structure for the electrical connector 19 when it is connected to clamping assembly 10. When the clamping assembly 10 is fully assembled, it provides reliable alignment, with solid support for the electrical connectors 19 to be positioned thereon for later clamping to provide electrical connection to the printed circuit board 15.

Figure 5:
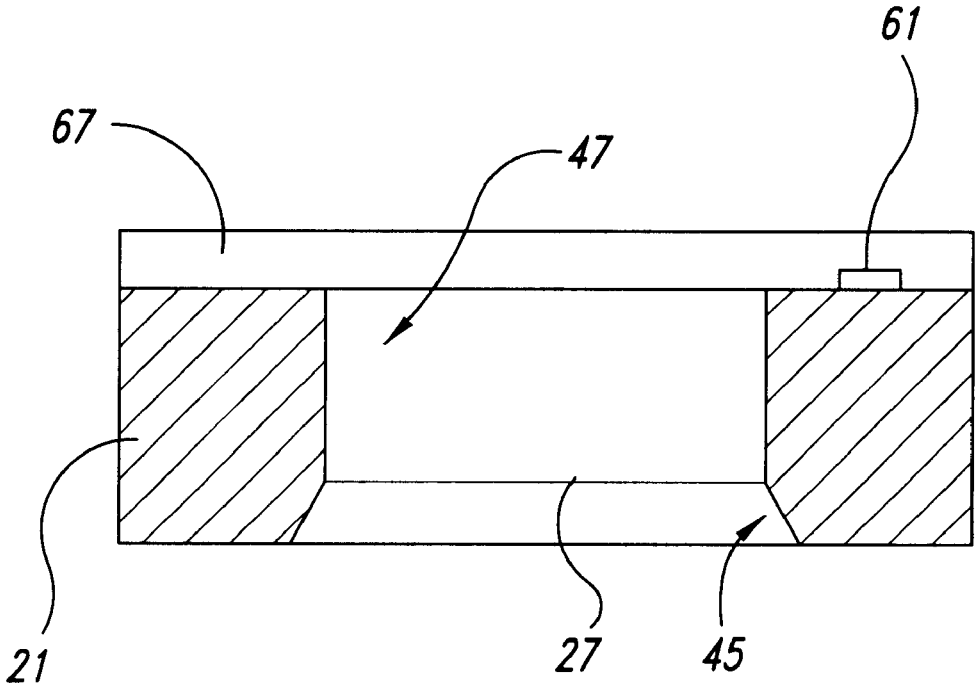
FIG. 5 is a cross-sectional view taken along lines 5—5 of FIG. 4.

FIG. 5 shows the frame 21 and an enlarged view of each of the individual openings 27. The frame 21 includes, as shown a pin 61 for receiving the electrically conductive strip as previously described. It also includes the alignment bar 67, which interacts with the alignment pin 61 so as to provide accurate alignment and registration of the electrical connector 19 when connected to the clamping member.

Opening 21 preferably has a tapered region 45 at a bottom portion thereof. The tapered region 45 has an enlarged opening at the bottom of the frame 21 which is larger than the opening at a top region 47 of the opening 27. The tapered opening 45 provides a bevel for quickly and easily fitting over the pressure pad 23. The tapered opening 45 is slightly larger than the pressure pad 23. The pressure pad 23, therefore, smoothly and easily fits into the very bottom portion of the opening 27 within the frame 21. The opening 27 tapers along the edge 45, shown in FIG. 5 to a size which is smaller than the pressure pad 23. This places a compressing force, in the form of a press fit onto the pressure pad 23. This press fit compresses the sidewalls of the pressure pad 23 and retains them in a firm, press fit condition so as to provide uniform, and tight pressure against the contact surface 114 for holding the electrical connectors of the electrodes 46 in place against the corresponding electrodes on the printed circuit board.

Figure 6:
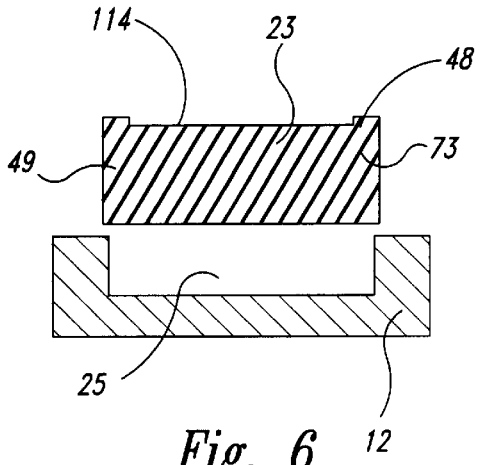
FIG. 6 is a cross-sectional view of one embodiment of the clamping member and pressure pad taken along lines 6—6 as shown in FIG. 4.

As shown in FIG. 6, each of the pressure pads 23 include a raised edge 48 along a periphery of the upper surface of the pressure pad. The upper surface of the pressure pad 23 contacts the end portion of the electrical connector 19 to bias the contacts 46 of the electrical connector against the contacts 30 (FIGS. 9 and 10). There is a tendency for the periphery of the resilient pressure pads 23 to sag downward and the sidewalls 49 and 73 to bulge outward as the clamping assembly 10 applies pressure to the connector 19. The raised edge 48 counteracts this tendency and helps to evenly distribute the pressure exerted on the electrical contacts 46 through the pressure pads 23 when the clamp is shut. The frame 21, and the recess 25 in the clamping member 12, each support the sides walls 49 and 73 of the pressure pads 23 to also alleviate the tendency for them to bulge. As an alternative, instead of a separate, discrete frame 21, the frame 21 can be an integral portion of the clamping members 12, for example an upright edge surrounding each of the recesses 25, or the recesses 25 could be made deeper.

As shown in FIG. 6 in a cross-sectional view, the pressure pad 23 fits into recess 25. The dimensions of the pressure pad 23 are slightly larger than the dimensions of the recess 25 to achieve a press fit of the pressure pad 23 in the recess 16. The press fit deforms the pressure pad 23, increasing the rigidity of the pressure pad 23 and reducing the tendency of the sidewalls 49 and 73 of the pressure pad 23 to bulge under pressure. Adhesive can be added if desired to provide rigidity to the mounting in addition to the press fit. The raised edges 48 can be achieved by molding, or by removing material from a center portion of the pressure pad 23.

Figure 7:
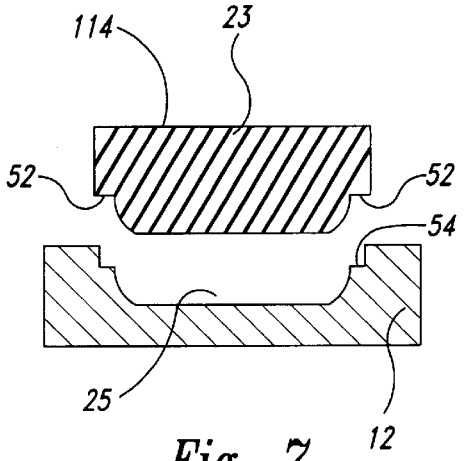
FIG. 7 is an alternative embodiment of the clamping member and pressure pad of the type shown in FIG. 4.

FIGS. 7 and 8A–8C show alternative embodiments of the pressure pad 23 and the recess 25. In FIG. 7, the pressure pad 23 has an approximately planar contacting surface and a shoulder 52 formed along a peripheral edge of contacting surface 114 of the pressure pad 23. The shoulder 52 extends around the periphery, and beyond the outer edge of the contact area 114 for the electrical contacts 46. The shoulder 52 thus provides additional lateral support for the upper surface so as to prevent the bulging of the sidewalls and retain the upper surface in a generally planar configuration during clamping. The recess 25 includes a support surface 54 for the pressure pad 23 about the periphery of the mounting surface. The shape of the shoulder 52 conforms to the shape of the recess 25 in the clamping member 12. The support shoulder 52 assists in countering the tendency of the sidewalls 73 and 49 of the pressure pad 23 to bulge under pressure. The pressure pad 23 is again press fit into the recess 25.

Figure 8A:
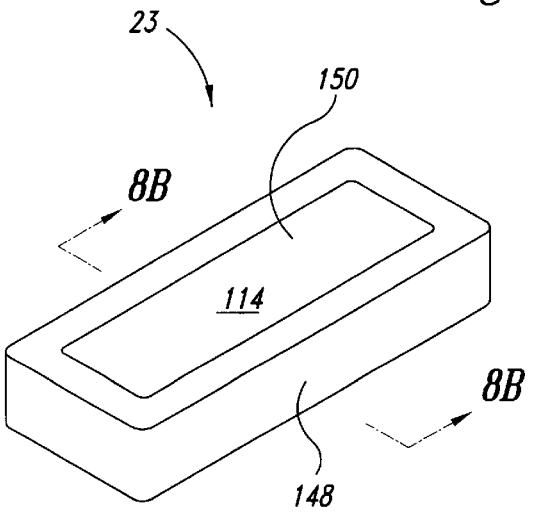
FIG. 8A is an alternative embodiment of a pressure pad according to the present invention.
Figure 8B:
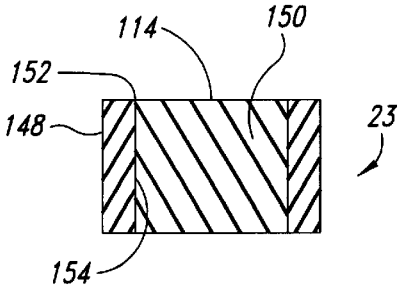
FIG. 8B is a cross-sectional view taken along lines 8B—8B of FIG. 8A.
Figure 8C:
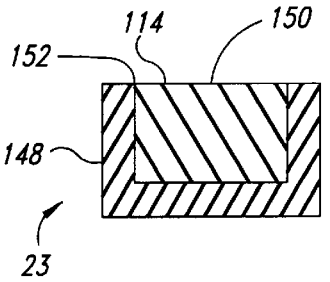
FIG. 8C is a farther alternative view of a pressure pad according to the present invention.

FIGS. 8A–8C illustrate further alternative embodiments of the pressure pad 23 according to principles of the present invention. The pad 23 includes a central member 150 composed of a first material and a second material 148 that is connected along the sidewalls of the material 150. Both of the materials, 150 and 148, can be a rubber or other deformable member. However, the material 148 is slightly more firm than the material used for 150. For example, the material 148 may be a somewhat harder rubber, or have a more firm response because it is a stiffer elastomeric member than the central portion 150. Having the pressure pad 23 composed of a two-part material also provides the advantage that when pressure is applied to the upper surface 114, the pad 23 will remain flat and uniform across this entire surface and provide an even support across the entire upper surface 114 so as to provide solid electrical contact of all pads 46.

FIG. 8B is a cross-sectional view taken along lines 8B—8B of FIG. 8A to illustrate the two materials 150 and 158 which comprise the pad 23. The outer layer 148 can be a sleeve into which the pad 150 is placed. In this embodiment, the pad 150 is slightly larger than the aperture in sleeve 148 so that the pad is compressed and held firmly in position.

FIG. 8C is a further alternative embodiment of pressure pad 23 in which the material 148 is like a box having a bottom as well as on the sidewall. This embodiment can be used to provide firm support inside the recess 25 and may be used in place of, or in addition to, an adhesive. The material 148 may also be of the type which works better with the adhesive than the material 150 and thus provides a good contacting surface for bonding the pad 23 to the clamp 12.

As previously stated FIGS. 8A–8C show an alternative embodiment of the resilient pressure pad 23, including a pressure pad sleeve 148 receiving a pressure pad core 150. The pressure pad sleeve 148 has a durometer value greater than a durometer value of the pressure pad core 150. The pressure pad sleeve 148 has an aperture 152 having dimensions slightly smaller than corresponding dimensions of the pressure pad core 150, to receive the pressure pad core 150 in a press fit. Thus, the pressure pad sleeve 148 supports the sidewall 154 of the pressure pad core 150. As seen in FIG. 8B, the aperture 152 can extend completely through the pressure pad sleeve 148, or can extend only partially through the pressure pad sleeve 148 as shown in FIG. 8C. The contacting surface 114 of the pressure pad core 150 is disposed over the contacts 46 on the end portion 48 of the electrical connector 19 to ensure that constant pressure is applied across the contacts 46. The pressure pad sleeve 148 does not press directly over any of the contacts 46, and so does not directly apply force to the contacts 46. The pressure pad sleeve can be mounted to the clamping surface 70, (see FIG. 10) or within the recesses 25 of the clamping member 12.

FIG. 9 shows two clamping members 12 and the pressure pads 23 undeformed, while the clamping members 12 are in the unclamped position. The frames 14 are not shown to improve the legibility of the drawing. The clamping surface 70 of the clamping member is tapered from a centerline 142, out toward the ends 20 and 22 of the clamping member 12. For example, a taper producing an angle θ of approximately 0.573 degrees may be sufficient. Tapers in the ranges of 0.1 to 2.0 degrees may be used. (The taper is not shown to scale in the figure, but shown enlarged for purposes of illustration.) Hence, the space between the clamping members 12 and board 40 increases towards the ends 20 and 22 near clamping bars 43 and 45. Similarly, the space between the electrical connectors 18 on pressure pads 16 and contacts 38 increases towards the ends 20 and 24 along the length of the clamping member 12 in anticipation of the bending of the clamping members 12 when they are to be clamped. As can be appreciated, when rods 43 and 45 apply force to hold the clamp 12 solid against the printed board 40, the force will be applied mostly at the end portions 20 and 22, thus deforming the bar 12. It is desirable to ensure that all electrical contacts between the connector 18 via contact points 46 and the printed circuit board 40 having contact electrodes 38 are precisely made, with uniform pressure applied to all contacts.

Accordingly, the principle of the present invention provides uniform pressure when clamped, of all electrical connectors 19, and of electrodes 46 to electrodes 75, by ensuring that even pressure is provided along the entire length of the bar 12 even though it is clamped at both ends. the pressure pads 23 are also configured to provide even pressure across the entire surface of the pad for each of the electrical contacts 46 when in the clamped position. As shown in FIG. 9, the pressure pads 23 have a slight upstanding ridge 48 around the edge portions, also as shown in the embodiment of FIG. 3. Once the clamps 12 are pressed firmly against the circuit board 15, the pressure pads 23 will be deformed to be uniformly flat across their entire surface and in addition the clamping members 12 will be uniformly flat along the surface which is presented to the printed circuit board 15, as shown in FIG. 10.

FIG. 10 shows the clamping members 12 of FIG. 9, with the clamping members 12 in a clamped position on circuit board 15. The force exerted by the clamping bars 43 on the ends 51, 53 of the clamping member 12 causes a slight bend in the clamping member 12. The taper in the clamping member 12 accommodates the bending of the clamping member 12 to produce an approximately planer clamping surface 70 when the clamping member 12 is in the clamped position. Hence, each of the pressure pads 23 exert a uniform pressure on their respective electrical connectors 19 and printed circuit boards 15.

In addition to the slight deformation of the clamping member 12, the pads 23 also undergo a slight deformation along their edge surfaces. The raised edge 48 is slightly depressed by the edge portions of the electrical connector 19. The additional pressure exerted by the compression of the raised edges 48 to the plane of the contacting surface 114 of the pressure pad 23 compensates for the pressure lost as the edges of the pressure pad 23 bulge slightly, due to the compression against the back of the electrical connector 19. Those electrical contacts 46 which are on the outermost edges of the electrical connector 19 are provided the same support and even pressure as those at the center portion of the pad 23. Thus, uniformly flat, and even pressure is provided to the electrical connectors 46 and 75 to hold them in contact with each other for an extended period of time.

FIG. 10 further illustrates how the posts 59 of the clamping member engage the holes 83 of the PCB 15, providing reliable alignment of the respective contacts.

The design of the present invention has the advantage that solid electrical contact is assured over long periods of time with high reliability. Over time, the metal, as well as the rubber, may fatigue slightly. The design of the present invention takes such fatigue into account so as to ensure that even pressure is applied over the life of the electrical connection. In addition, in the event that the electrical connectors are to be removed, the clamp member 12 can be easily removed and appropriate adjustments made and then reconnected with a high degree of assurance that even pressure will be applied to all electrical connectors 46 and 75 without loss of connection.

Figure 11:
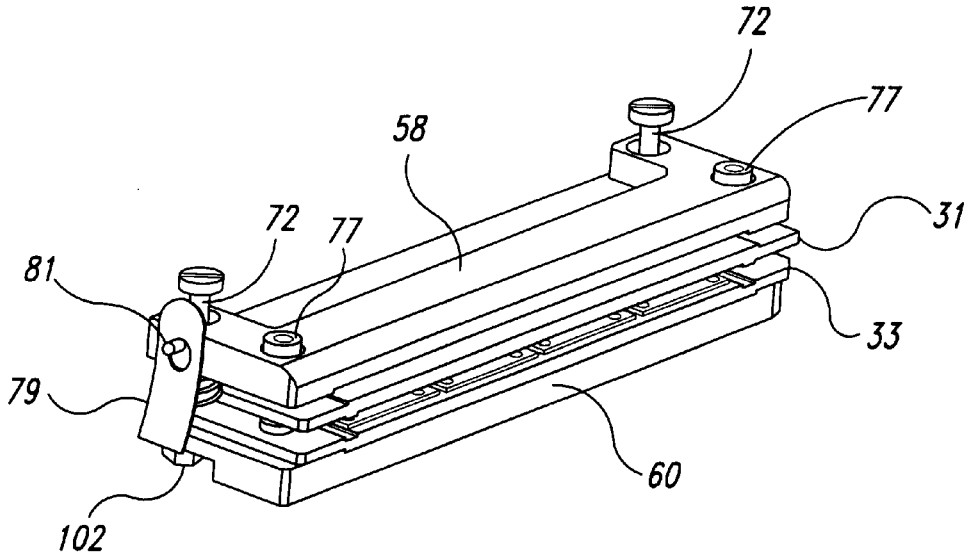
FIG. 11 is an isometric view of an alternative embodiment of a clamp assembly in the preloaded condition, prior to final clamping.
Figure 12:
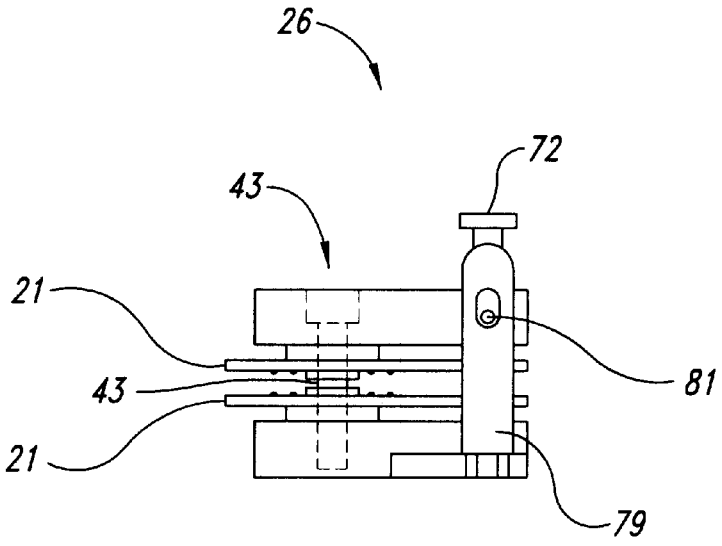
FIG. 12 is a side elevational view of the clamping assembly of FIG. 11 in a fully clamped position.

FIG. 11 illustrates a further alternative embodiment of a clamping assembly 26. It is shown in the preloaded position. The two front fasteners 43 are threaded and serve as the final fasteners at the front of the clamping members 58, 60 to hold the electrical connections in a solid position between the clamping members 58, 60. The rear fasteners 72 align the clamping members 58 and 60 in the open position. The threads of the front fasteners 43 engage a respective portion of the first and second clamping members 58, 60 to move the first and second clamping members 58, 60 with respect to one another. For example, a lower threaded portion of the front fasteners 43, (see FIGS. 2 and 12), engages a thread in the hole 76 of the second clamping member 60, while a head portion 77 of the front fastener 43 engages a well 85 in the hole 76 of the first clamping member 58. Thus, the distance or space between the clamping members 58, 60 can be adjusted by rotating the front fasteners 43.

The clamping assembly 26 is designed to provide quick and easy clamping, and has significant advantages as will now be explained. The clamp 26 as shown in FIG. 2 is in the fully open position. The open position is characterized by fastener 72 at the rear of the clamp holding the two clamp members 58 and 60 connected to each other with a solid connection. Spring 78 biases the clamping members 58 and 60 away from each other to hold the clamp in the fully open position. Spring clip 79 connected to the clamping member 60 is not connected to the other clamping member 58 so that the two clamping members are held together only by the rear fasteners 72. Since the spring 78 is biasing it into the open position, a user may easily grasp the clamp and position it over a printed circuit board with good clearance on each side so that it may be quickly and easily positioned. Once the clamp 26 is positioned over the edge of the printed circuit board, it is advanced from the fully open position to the preloaded position, see FIG. 11. This is accomplished by slightly depressing clamping member 58 towards clamping member 60, compressing spring 78 until spring clips 79 engage keeper pins 81. During this procedure, the operator guides the posts 57 into the holes 83 (see FIGS. 9, 10) of the circuit board 15. The alignment of the posts 57 with the holes 83 will provide dependable alignment of the contacts 46 on the electrical connectors 19 with the contacts 75 on the circuit board 15.

Although specific embodiments of and examples for, the invention are described herein for illustrative purposes, various equivalent modifications can be made without departing from the spirit and scope of the invention, as will be recognized by those skilled in the relevant art. The teachings provided herein of the invention can be applied to other electrical connectors, not necessarily the exemplary clamping electrical connector generally described above. For example, the pressure pads can be used with a variety of clamping assemblies beyond the types shown herein.

These and other changes can be made to the invention in light of the above detailed description. In general, in the following claims, the terms used should not be construed to limit the invention to the specific embodiments disclosed in the specification and the claims, but should be construed to include all connectors and clamping devices that operate in accordance with the claims. Accordingly, the invention is not limited by the disclosure, but instead its scope is to be determined entirely by the following claims.

We claim:

1. An electric connector assembly, comprising:

a base having a recess;

a resilient pressure pad, having a size and dimension to fit into the recess under compression with a press fit, and including a contacting surface having a raised region along a perimeter thereof;

an electrical connector having a plurality of electrodes on a first surface thereof, the electrical connector being positioned above the resilient pressure pad; and a clamp structure adapted to connect the base to a circuit board such that the contacting surface of the pressure pad bears against a second surface of the electrical connector, biasing the plurality of electrodes against a corresponding plurality of contact pads on the circuit board.

2. The connector of claim 1 wherein the alignment structure on the frame includes a notch on each of a first end and a second end of the frame, each of the notches sized and positioned to receive a respective tab of the base.

3. The electrical connector assembly of claim 1 wherein the resilient pressure pad includes a contacting surface that bears against the second surface of the electrical connector, the contacting surface having a perimeter region having a durometer of a first value and an inner region having a durometer of a second value, lower than the first value.

4. The electrical connector assembly of claim 1 wherein:

the recess is one of a plurality of recesses in the base;

the resilient pressure pad is one of a plurality of resilient pressure pads, each having a size and dimension to fit into a respective one of the recesses;

the electrical connector is one of a plurality of electrical connectors, each having a plurality of electrodes on a first surface thereof and each of the plurality of connectors being positioned above a respective one of the plurality of pressure pads;

a clamp structure adapted to connect the base to a circuit board such that each of the plurality of pressure pads bears against a second surface of a respective one of the plurality of electrical connectors, biasing the respective plurality of electrodes against a corresponding plurality of contact pads on the circuit board.

5. The connector according to claim 1, further including:

a frame member connected to the base member, the frame member having a plurality of apertures therethrough, the apertures being sized to fit over and surround the pressure pads.

6. The connector according to claim 5 wherein the side wall of the apertures includes a tapered edge such that the opening size at the bottom of the aperture is a first, larger size and the opening size at the top region of the opening is a second, smaller size.

7. The connector of claim 1 wherein the base includes an alignment structure and the frame includes an alignment structure on a first end and a second end of the frame, each of the alignment structures being sized and positioned to align with the alignment structure on the base.

8. The connector of claim 4 wherein the alignment structure on the frame includes at least one hole on each of a first end and a second end of the frame, each of the holes sized to receive a respective alignment post on the base.

9. A clamp for electrically coupling printed circuits, comprising:

first and second clamping members, the clamping members movable with respect to one another between a clamped position and an unclamped position spaced from the clamped position and configured to receive a circuit board having contact pads on a first surface thereof between the first and second clamping members;

a resilient pressure pad including a contacting surface having a raised region along a perimeter thereof, the pad secured to the first clamping member and facing the second clamping member; and a frame positioned adjacent the first clamping member and having an opening for the pressure pad on the first clamping member, the opening sized and dimensioned to receive the pressure pad.

10. The clamp of claim 9 wherein the size of the openings is less than a size of the respective pressure pads, the openings retaining the pressure pads in a press fit.

11. The clamp of claim 9 wherein the frame includes a clamping member alignment structure to mate with an alignment structure on the first clamping member.

12. The clamp of claim 9 wherein the frame includes a conductor alignment structure to mate with an alignment structure on a flexible electric circuit strip, the flexible electric circuit strip having electrodes thereon for contacting the printed circuit board.

13. The clamp of claim 9 wherein the conductor alignment structure includes a plurality of pins extending from the frame.

14. The clamp of claim 9 wherein the frame is configured to receive a flexible electric circuit strip between the frame and the circuit board such that when the first and second clamping members are in the clamped position the contacting surface of the pad bears against the circuit strip, biasing the circuit strip against the first surface of the circuit board.

15. The clamp of claim 14, further comprising the circuit board.

16. The clamp of claim 14, further comprising the flexible electric circuit strip.

17. The clamp of claim 14 wherein:

the resilient pressure pad is one of a plurality of resilient pressure pads secured to the first clamping member and facing the second clamping member; and the frame has a respective opening for each of the plurality of pressure pads on the first clamping member, the openings sized and dimensioned to receive the respective one of the plurality of pressure pads, the frame configured to receive a plurality of flexible electric circuit strips between the frame and the circuit board such that when the first and second clamping members are in the clamped position each of the plurality of resilient pressure pads bears against a respective one of the plurality of circuit strips, biasing each of the plurality of circuit strips against the first surface of the circuit board.

18. The clamp of claim 17, further comprising:

an additional plurality of resilient pressure pads secured to the second clamping member and facing the first clamping member; and an additional frame positioned adjacent the second clamping member and having a respective opening for each of the additional plurality of pressure pads on the second clamping member, the openings sized and dimensioned to receive the respective one of the additional plurality of pressure pads, the frame configured to receive an additional plurality of flexible electric circuit strips between the frame and the circuit board such that when the first and second clamping members are in the clamped position each of the additional plurality of resilient pressure pads bears against a respective one of the additional plurality of circuit strips, biasing each of the plurality of circuit strips against a second surface of the circuit board.

19. A clamp for electrically coupling printed circuit boards, comprising:

a first clamping member;

a second clamping member opposed to the first clamping member and movable with respect thereto between a clamped position and an unclamped position spaced from the clamped position; and a first resilient pressure pad having a contacting surface and a peripheral edge portion along a periphery of the contacting surface, the first resilient pressure pad secured to the first clamping member for movement therewith such that the contacting surface of the first pressure pad generally faces the second clamping member, the contacting surface positioned to bias a flexible electric circuit path into physical and electrical contact with a circuit board in the clamped position.

20. The clamp of claim 19 wherein the first resilient pressure pad is mounted in a first recess in the first clamping member.

21. The clamp according to claim 19 wherein the resilient pressure pad having a step region thereon.

22. The clamp according to claim 19 wherein the contact surface of the resilient pressure pad includes a core member having a first durometer value and the peripheral edge portion includes a sleeve member having a second durometer value, the sleeve member surrounding the core member, so as providing a peripheral edge portion therefore.

23. The clamp according to claim 19 wherein the first resilient pressure pad contact surface is comprised of a core member and the peripheral edge portion is comprised of a cup member having side walls and a bottom surface, the side walls and the bottom surface having a higher durometer value than the core member.

24. The clamp of claim 19 wherein the peripheral portion includes a raised edge extending along an entire length of the periphery of the contacting surface.

25. The clamp of claim 24 wherein the raised edge has a uniform height and a uniform width along an entire length of the periphery of the contacting surface.

26. The clamp of claim 19, further comprising:

a frame positioned adjacent the first clamping member, the frame having a first opening, the first resilient pressure pad being press fit within the first opening.

27. The clamp according to claim 26 wherein the opening within the frame has a taper portion at the bottom region thereof and a narrow portion at the top region thereof, the taper portion having a large opening for fitting around the resilient pressure pad and the top region having a more narrow opening than the size of the resilient pressure pad so as to compress the resilient pressure pad in a press fit within the opening.

28. The clamp according to claim 26 further including an electrically conductive strip having a plurality of electrodes thereon, the electrically conductive strip being coupled to the frame member and positioned for being placed in electrical contact with electrodes on the printed circuit board.

29. A clamp for electrically coupling printed circuit boards, comprising:

a first clamping member;

a second clamping member opposed to the first clamping member and movable with respect thereto between a clamped position and an unclamped position spaced from the clamped position;

a first resilient pressure pad secured to the first clamping member for movement therewith such that a contacting surface of the first pressure pad generally faces the second clamping member, the contacting surface positioned to bias a flexible electric circuit path into contact with a circuit board in the clamped position, the contacting surface including a core member and a peripheral edge portion, the peripheral edge portion comprised of a cup member having side walls and a bottom surface, the side walls and the bottom surface having a higher durometer value than the core member.

30. A clamping assembly for electrical connectors, comprising:

a resilient pressure pad having a back surface and a contacting surface opposing the back surface;

a perimeter region of the contacting surface having a first thickness from the back surface;

an interior region of the contacting surface having a second thickness from the back surface, less than the first thickness;

biasing means for causing the contacting surface to bear against a first side of a flexible circuit strip, causing thereby a second side of the circuit strip to bear against a circuit board.

31. The clamping assembly of claim 30, further including the flexible circuit strip and the circuit board.

* * * * *

UNITED STATES PATENT AND TRADEMARK OFFICE

CERTIFICATE OF CORRECTION

PATENT NO. : 6,500,010 B2
DATED : December 31, 2002
INVENTOR(S) : Alexander I. Yatskov It is certified that error appears in the above-identified patent and that said Letters Patent is hereby corrected as shown below:

Title page,
Item [56], U.S. PATENT DOCUMENTS, "5,730,618" should read as -- 5,730,619 --.

Column 10,
Line 31, "The connector of claim 4" should read as -- The connector of claim 7 --.

Signed and Sealed this

Fifteenth Day of July, 2003

JAMES E. ROGAN
*Director of the United States Patent and Trademark Office*